US007093719B2

(12) United States Patent
Roper

(10) Patent No.: US 7,093,719 B2
(45) Date of Patent: Aug. 22, 2006

(54) TRANSPORTABLE, SELF-CONTAINED, RECIRCULATION, WASH PLANT

(76) Inventor: Virgil Leland Roper, P.O. Box 1045, Lincoln, MT (US) 59639

( * ) Notice: Subject to any disclaimer, the term of this patent is extended or adjusted under 35 U.S.C. 154(b) by 300 days.

(21) Appl. No.: 10/767,366

(22) Filed: Jan. 28, 2004

(65) Prior Publication Data

US 2005/0183992 A1 Aug. 25, 2005

(51) Int. Cl.
*B07B 1/49* (2006.01)

(52) U.S. Cl. ..... 209/420; 209/18; 209/421; 209/268; 209/269; 209/309

(58) Field of Classification Search ..... 209/420, 209/421
See application file for complete search history.

(56) References Cited

U.S. PATENT DOCUMENTS

| | | | | | |
|---|---|---|---|---|---|
| 1,309,754 | A * | 7/1919 | Dovel | 209/270 |
| 2,049,962 | A * | 8/1936 | Lamberson | 209/44 |
| 2,294,587 | A * | 9/1942 | Vissac | 209/458 |
| 3,232,426 | A * | 2/1966 | Caparrella et al. | 209/44 |
| 3,439,806 | A * | 4/1969 | Kass et al. | 209/260 |
| 4,178,238 | A * | 12/1979 | Harris | 209/270 |
| 4,525,270 | A * | 6/1985 | McCann | 209/44 |
| 4,592,833 | A * | 6/1986 | Perdue | 209/44 |
| 4,642,180 | A * | 2/1987 | Kaufman | 209/44 |
| 4,966,686 | A * | 10/1990 | Sherman | 209/255 |
| 5,106,490 | A * | 4/1992 | McDonald | 209/240 |
| 5,108,584 | A * | 4/1992 | Brosseuk | 209/44 |
| 5,287,975 | A * | 2/1994 | Chumley et al. | 209/3 |
| 5,421,461 | A * | 6/1995 | Ruzic | 209/44 |
| 5,577,618 | A * | 11/1996 | Rafferty | 209/421 |
| 5,785,182 | A * | 7/1998 | Ashcraft | 209/44 |
| 6,065,606 | A * | 5/2000 | Bonner | 209/420 |
| 6,698,594 | B1 * | 3/2004 | Cohen et al. | 209/421 |
| 6,799,681 | B1 * | 10/2004 | Warren | 209/44 |
| 6,843,376 | B1 * | 1/2005 | Dube et al. | 209/421 |
| 2005/0006284 | A1 * | 1/2005 | Zeller | 209/404 |

OTHER PUBLICATIONS

Keene Engineering, Manufacturer of Mining Dec. 20, 2003 at Keeneeng.com Introducing the Gold Rush Mini Power Sluice.

* cited by examiner

*Primary Examiner*—Kathy Matecki
*Assistant Examiner*—Jonathan R. Miller

(57) ABSTRACT

A combination of prospecting equipment and apparatus, for the purpose of collecting precious minerals from mineral bearing sand and gravel, located in regions that are arid in nature, have little water or limited water usage, due to environmental concerns. The Wash Plant Unit comprising; A feed hopper for receiving and washing materials. A sluice box and apparatus for collecting precious minerals. A sluice box extension with a filter screen for separating gravel from sand and water. A filtration box with a sediment pan and screening devices for separating sand from water. A receptacle and implement holder for holding miscellaneous prospecting supplies. A water pump with a suction and discharge for drawing and dispensing water. All built upon and attached to its own water reservoir, which is attached to a frame with a hitch, built upon a set of axles with tires, suitable for being transported by an All Terrain Vehicle.

3 Claims, 5 Drawing Sheets

TRANSPORTABLE, SELF-CONTAINED, RECIRCULATION, WASH PLANT

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This Invention relates to recreational prospecting, namely, A Transportable, Self-Contained Recirculating, Wash Plant, for use in washing and separating precious minerals, such as gold and silver, from mineral bearing sand and gravel, located in arid regions, areas with little water and areas that have water use restrictions, due to environmental concerns.

2. Background of the Invention

In the past, various methods have been employed, in the use of water, for the purpose of recreational prospecting. These methods, such as, "slucing", "highbanking" and "dredging", use mineral bearing sand and gravel located at or near a water source, such as streams and rivers.

Although these methods have been satisfactory for their purpose, they are not satisfactory for the purpose of prospecting with water, in mineral bearing regions, that are arid in nature, have little water and areas that have water use restrictions, due to environmental concerns.

BACKGROUND OF INVENTION—OBJECTS AND ADVANTAGES

A main objective of my invention is to provide a custom built Wash Plant, for the purpose of separating precious minerals from sand and gravel, located in regions that are arid in nature, have little water or water use restrictions, due to environmental concerns, and to attach the Wash Plant to its own water reservoir.

Another object of my invention is to attach the Wash Plant and Reservoir, along with a pump, to a frame complete with a tongue and hitch, built on a set of axles with tires, making the unit capable of, but not limited to, being transported by means of an All Terrain Vehicle.

Yet another object and an obvious advantage of my invention, is to provide a series of filtering devices, along with a system, for continuously filtering gravel and sand from water, before the water is returned to its water reservoir and recirculated, allowing the water to be used over and over, for several applications.

And yet another advantage of my invention is to provide an attached enclosed receptacle, with an implement holder, as a means of transporting miscellaneous prospecting gear, such as buckets and shovels.

Further objects and advantages of my invention will be made apparent by an examination of the drawings and descriptions.

SUMMARY

A combination of equipment, methods and means, for the use of water in recreational prospecting, in mineral bearing regions, that are arid in nature, have little water or water use limitations, due to environmental concerns, is described;

The invention includes an enclosed water reservoir, which has a water fill hole, a water port and a water drain. The reservoir is built upon and attached to a frame, with a tongue, including an adjustable jack stand, and a hitch, mounted to a set of axles with tires, making it transportable, by means of an All Terrain Vehicle.

Further included is a recirculating Wash Plant Unit, comprising a feed hopper with a grizzly screen and nozzles, mounted to a sluice box, the sluice box has an extension, containing a filter screen. The sluice box and extension are mounted on top of a filtration box, which contains a sediment pan, a series of screening devices and a water fill hole. The Wash Plant is mounted on top of the reservoir, allowing the water fill holes to become aligned.

The invention further includes an enclosed receptacle with an implement holder, for transporting extra prospecting equipment, such as, buckets and shovels. The receptacle is mounted on top of the reservoir and adjacent to the Wash Plant.

Further included is a water pump, which has a suction hose that is connected to the water port of the reservoir, and a discharge hose which is attached to a manifold, connected to a control valve, which is connected to the feed hopper nozzles.

For ease of operation, the reservoir is filled with water and transported to a mineral bearing location. During operation the adjustable jack stand is lowered to the ground and locked into position, so as to level the Wash Plant Unit. The pump is engaged and the control valve adjusted to provide an adequate flow of water. Material is placed into the feed hopper. The water pump, being engaged, draws water from the water port, through the manifold, which discharges water through the nozzles on the feed hopper, washing the materials. Materials smaller than the grizzly screen are washed onto the sluice box, where the precious minerals are captured. The excess materials and water continue along the sluice box extension onto the screen, water and particles of sand are percolated through the screen into the sediment pan, fine sand settles into the sediment pan, the water overflows and continues into the filtration box, where any leftover particles of sand are captured by the screening devices. The water flows through the water fill hole and back into the reservoir, where it is constantly recirculated.

DRAWINGS—FIQURES

Referring to the drawings and descriptions, A Transportable, Self-Contained, Recirculating, Wash Plant is shown and described in its preferred embodiments.

DRAWINGS—REFERENCE NUMERALS

| | | | |
|---|---|---|---|
| 10 frame | 12 tongue | 14 hitch | 16 extended frame |
| 18 axle | 20 tires | 22 axle supports a, b | 24 jack stand |
| 25 clevis pin | 26 basket | 28 reservoir | 30 1" flange |
| 32 water port | 34 water drain | 36 lid | 37 bolt holes a, b, c |
| 38 water fill hole a, b | 39 cover plate | 40 filtration box | 42 extended front |
| 44 mounting bracket | 46 filtering devices | 48 machine screws | 50 splash guard |
| 52 hole a, b | 54 sediment pan | 56 wing nuts a, b, c | 60 fenders a, b |
| 62 receptacle | 63 hinged lid | 64 keyed lock | 66 sluice box |
| 67 implement holder | 68 miners moss | 69 riffle tray | 70 machine bolts |
| 71 angled bracket | 72 punch plate | 74 sluice extension | 76 filter screen |
| 78 feed hopper | 80 grizzly screen | 81 vertical support | 82 hinge |
| 83 nozzles | 84 pipe fittings | 86 water pump | 87 suction |
| 88 discharge | 89 hose | 90 manifold ports a, b | 91 hose clamp |
| 92 control valve | | | |

DETAILED DESCRIPTIONS—PREFERRED EMBODIMENTS

Figure 3:
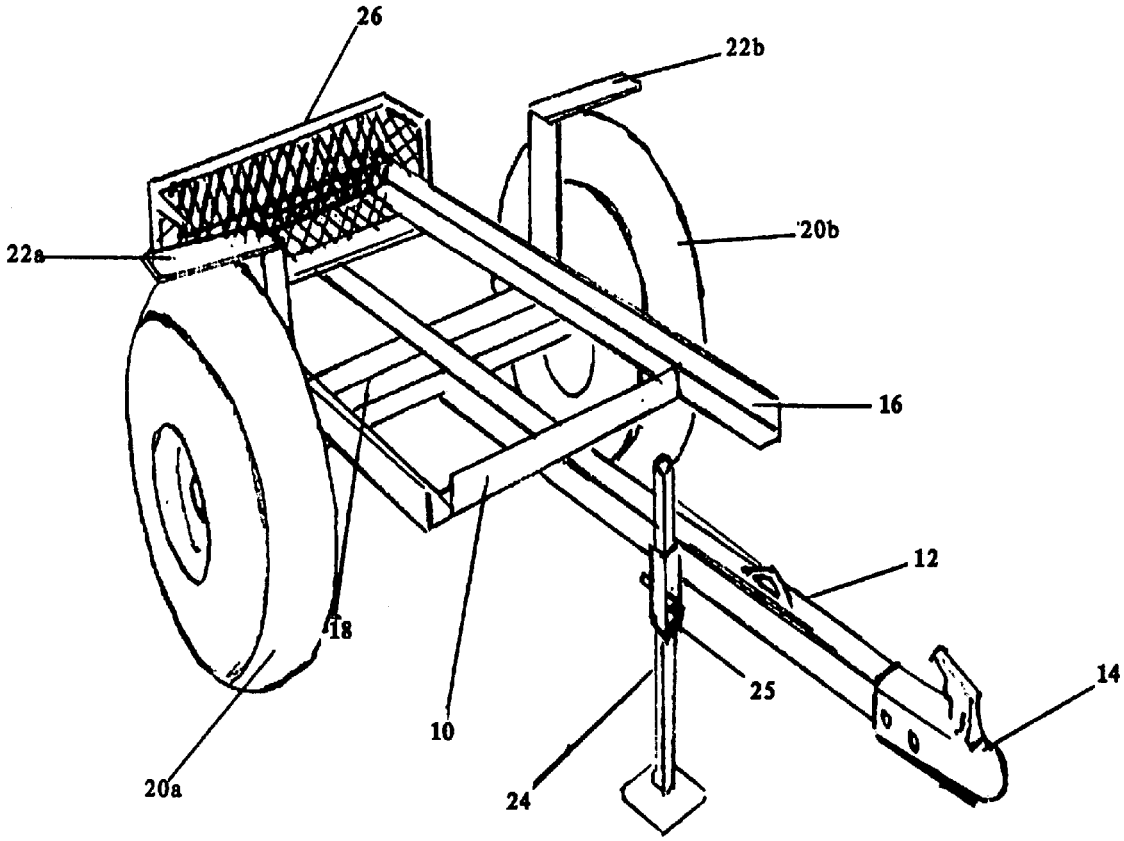
FIG. 3, shows a preferred frame and axle assembly.

FIG. 3, shown is a custom welded steel frame 10 with a tongue 12 and a hitch 14. An extended frame 16 is shown welded to tongue 12. Frame 10 is shown centered over and welded to an axle 18, with tires 20. Axle supports 22*a*&*b* constructed from angle iron and bent at a 90 degree angle, are extended vertically and welded to each end of axle 18. Axle supports 22*a*&*b* are also welded to frame 10. A frame thus formed secures maximum strength and support on which is built a water reservoir 28 FIG. 4 along with a preferred combination of prospecting equipment and apparatus. Included for use in leveling the unit, while in operational position is an adjustable jack stand 24, which is welded to frame 10. It is preferred that a clevis pin 25, be used as a locking device, to secure jack stand 24. A basket 26, welded to the back of frame 10, provides extra cargo space.

Figure 4:
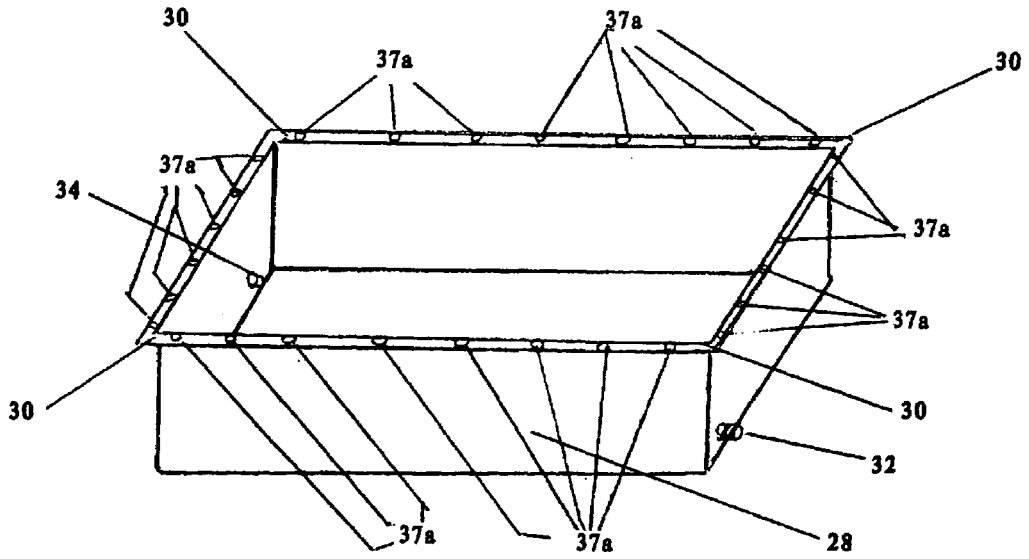
FIG. 4, shows a preferred water reservoir.

FIG. 4, Shown is a reservoir 28, suitable for holding up to 35 gallons of water. Reservoir 28 is constructed from 0.080 aluminum, suitably bent and welded, so as to form two parallel sides a front and a back. The top sides are bent to provide a 1" flange 30, extending the perimeter of reservoir 28. Weather stripping not shown, is attached to flange 30. Suitable bolts 37*a* drilled into flange 30 surround its perimeter. A water port 32 is welded to the front lower corner of reservoir 28. A water drain 34 is welded to the back lower corner of reservoir 28, thus allowing reservoir 28 to be emptied while not in use.

Figure 5:
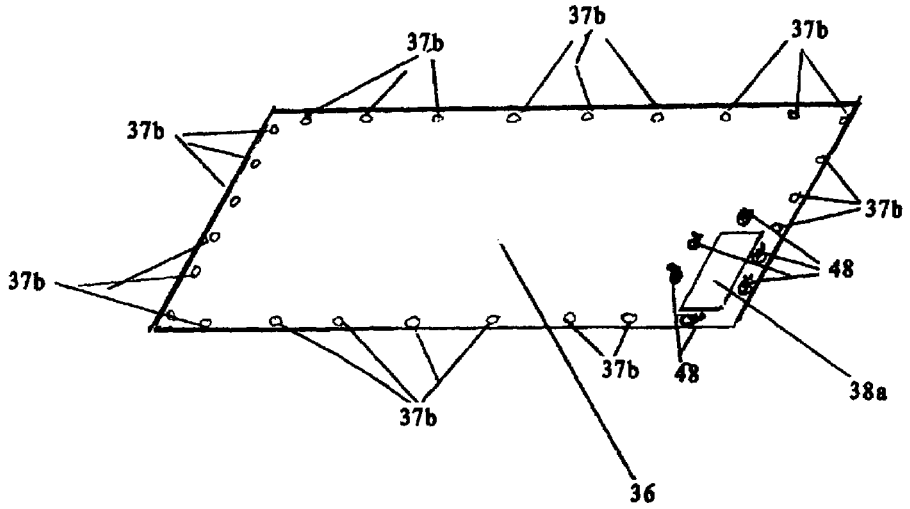
FIG. 5, shows a preferred lid, containing a water fill hole.

FIG. 5, Shown is a lid 36, cut from 0.080 aluminum, it is flat and of a suitable size to cover reservoir 28 FIG. 4 and extend to the edges of flange 30 FIG. 4. A pattern of bolt holes 37*b*, which match bolt holes 37*a* FIG. 4 are drilled into lid 36. A suitable section, rectangular in shape, cut from lid 36 forms a water fill hole 38*a*, machine screws 48, inserted through the underside of lid 36, extend vertically, surrounding water fill hole 38*a*.

Figure 6:
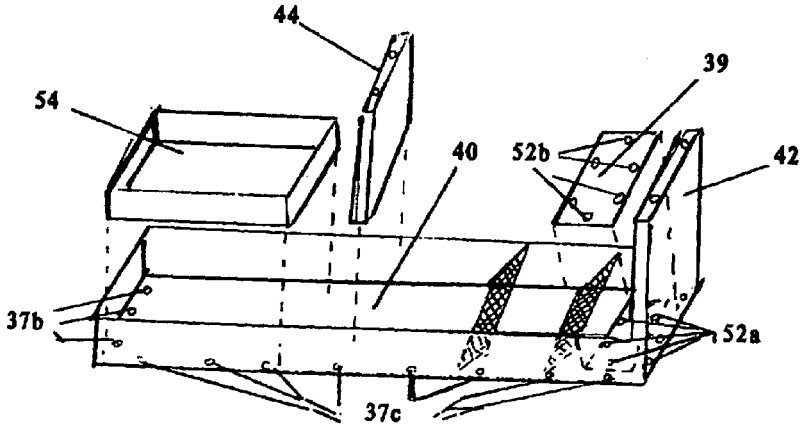
FIG. 6, shows a preferred filtration box and filtering devices.

FIG. 6, shown is a filtration box 40, constructed from 0.080 aluminum, bent to form two parallel sides, a bottom, a back and a vertically extended front 42. A suitable number of bolt holes 37*c*, which will later be used to attach filtration box 40 to lid 36 FIG. 5, are drilled into the bottom of filtration box 40. Two sets of slot, not shown, are welded to the inside of filtration box 40, the slots are of a suitable size to hold two removable filtering devices 46. A water fill hole 38*b*, matching the size and shape of water fill hole 38*a* FIG. 5, is cut from the bottom of filtration box 40. A splash guard 50 is inserted into water fill hole 38*b*. Holes 52*a* are drilled through splash guard 50 and surround water fill hole 38*b*, holes 52*a* match the number and pattern of machine screws 48 FIG. 5. A flat cover plate 39, having pre drilled holes 52*b*, matching the number and pattern of holes 52*a*, is placed over guard 50 and aligned. A removable sediment pan 54, constructed from 0.080 aluminum, bent to form a bottom and four sides is placed into filtration box 40. A mounting bracket 44, extending vertically, is welded to the sides of filtration box 40.

Figure 1:
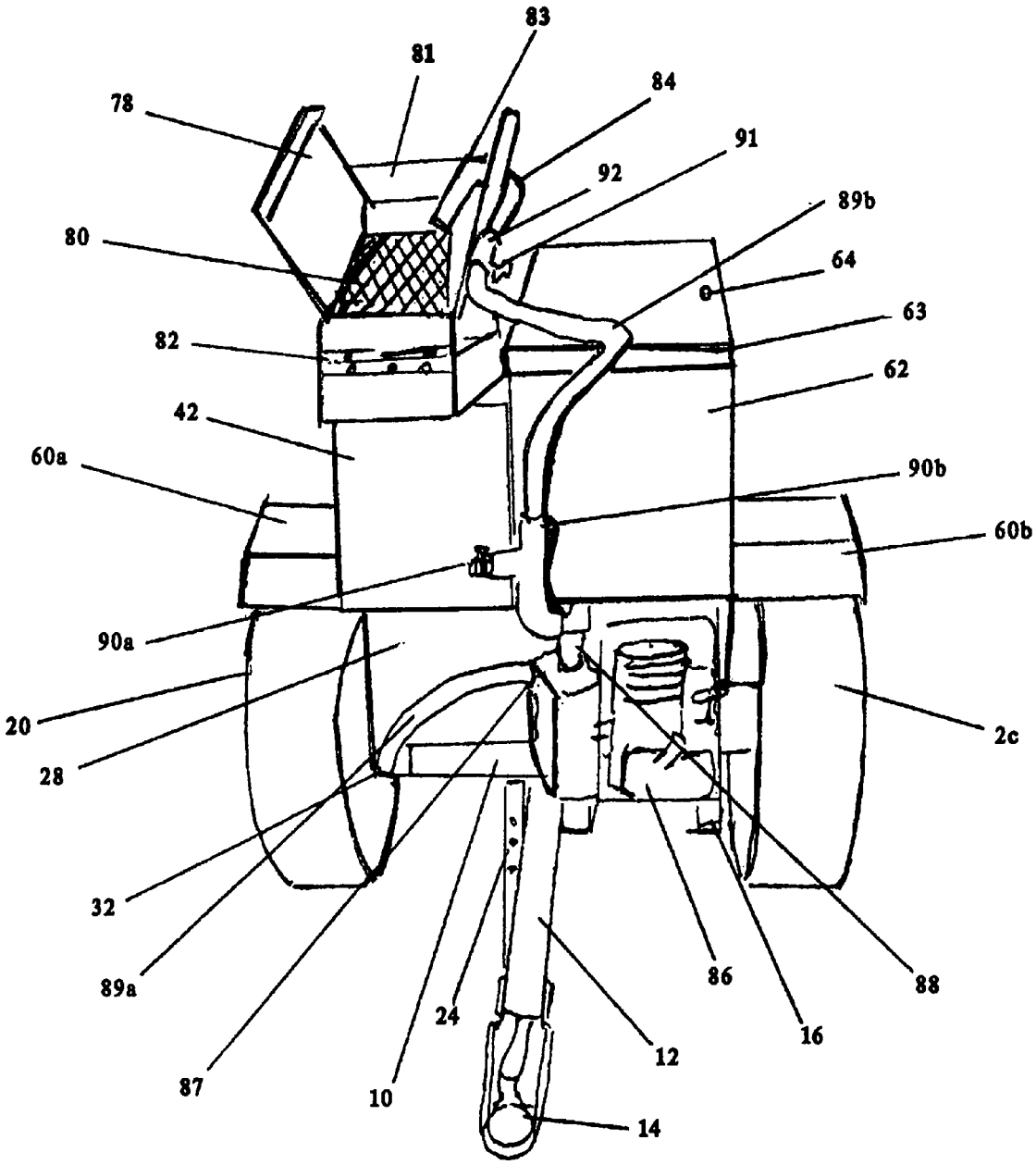
FIG. 1, shows a front view of a completed Wash Plant Unit in operational mode.
Figure 2:
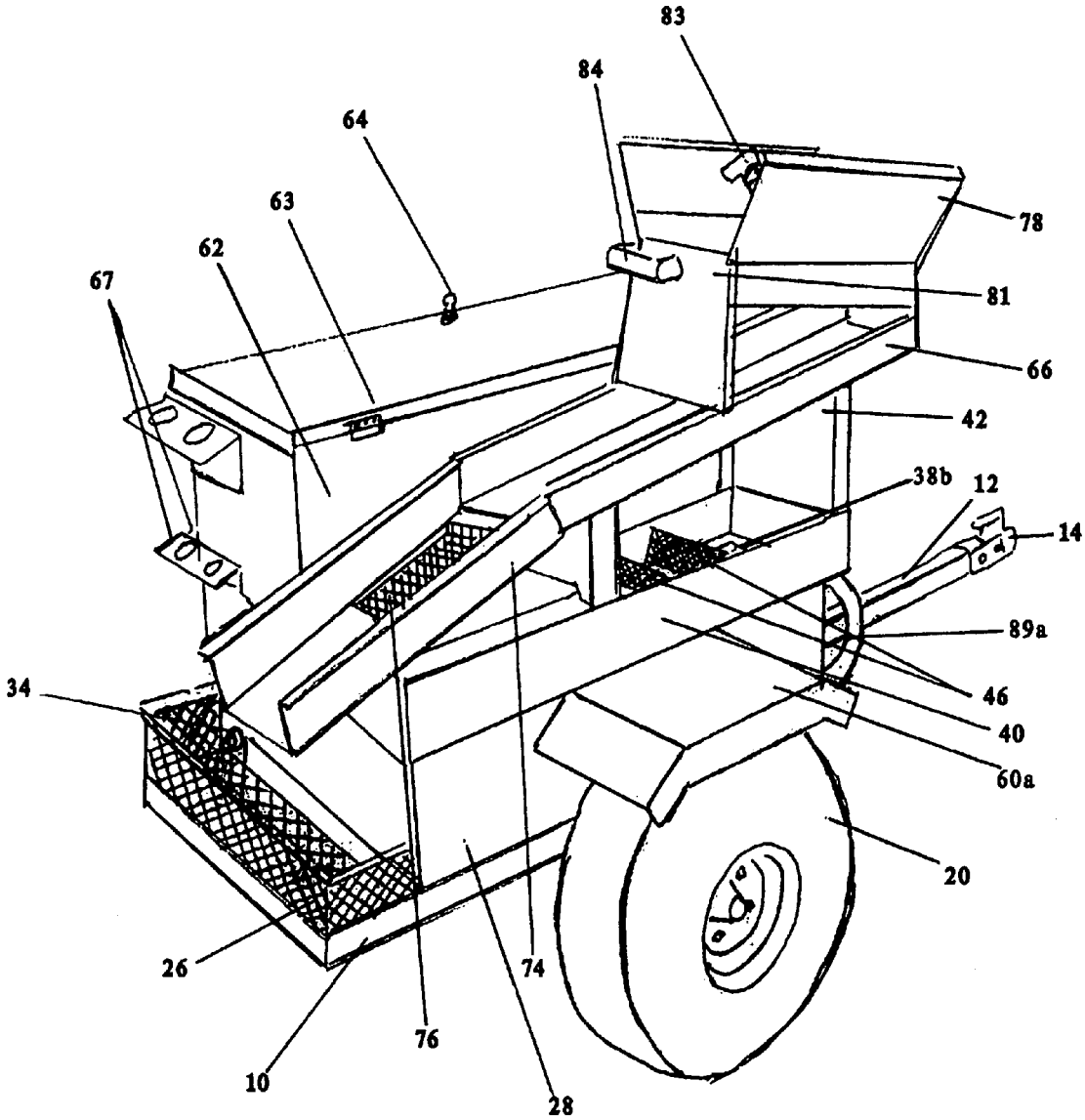
FIG. 2, shows an angled view of a completed Wash Plant Unit.

FIGS. 1 & 2, shown are views of completed Wash Plants, fenders 60*a* FIGS. 1&2 and 60*b* FIG. 1 are placed on axle supports 22*a* & 22*b* FIG. 3. Reservoir 28 FIG. 4 is placed on frame 10 FIG. 3, part of flange 30 FIG. 4 is rested on fenders 60*a* FIGS. 1& 2 and 60*b* FIG. 1. Lid 36 FIG. 5 is placed on reservoir 28 FIG. 4, aligning bolt holes 37*a* FIG. 4 with bolt holes 37*b* FIG. 5. Filtration box 40 FIG. 6 is placed on lid 36 FIG. 5, aligning bolt holes 37*c* FIG. 6 with bolt holes 37*a* FIG. 4 and bolt holes 37*b* FIG. 5. Splash guard 50 FIG. 6 is inserted through water fill hole 38*a* FIG. 5, holes 52*a* FIG. 6 and 52*b* FIG. 6 are inserted through machine screws 48 FIG. 5, thus joining water fill hole 38*b* FIG. 6 with water fill hole 38*a* FIG. 5, and allowing cover plate 39 FIG. 6 to be placed over water fill holes 38*a* and 38*b*, where it is secured by fastening devices such as wing nuts, not shown. A receptacle 62 FIGS. 1&2, constructed from 0.080 aluminum, bent and riveted, has a bottom, four sides, a hinged lid 63 FIG. 1,2 and a keyed lock 64 FIG. 1, 2, attached to the back side of receptacle 62 is an implement holder 67. Bolt holes, not shown, drilled into the bottom of receptacle 62 match bolt holes 37*a* FIG. 4 and 37*b* FIG. 5. Receptacle 62 is placed on top of lid 36 FIG. 5, adjacent to filtration box 40. At this point, the units as described, are attached and secured as follows;

One machine bolt, not shown is inserted through the bottom of filtration box 40 FIG. 6, lid 36 FIG. 5, flange 30 FIG. 4, fender 60*a* FIG. 1,2, axle support 22*a* FIG. 3, secured by a self locking nut, not shown, One machine bolt, not shown, inserted through the inside bottom of receptacle 62, lid 36 FIG. 5, flange 30 FIG. 4, fender 60*b* and axle support 22*b* FIG. 3, secured by a self locking nut, not shown.

Two machine bolts, not shown, are inserted through the inside bottom of filtration box 40 FIG. 6, lid 36 FIG. 5, flange 30 FIG. 4 and fender 60*a*, secured by self locking nuts, not shown. Two machine bolts, not shown, are inserted through the inside bottom of receptacle 62, lid 36 FIG. 5, flange 30 FIG. 4 and fender 60*b*, secured by self locking nuts, not shown.

A suitable number of machine bolts, not shown, are inserted through the bottom of filtration box 40 FIG. 6, lid 36 FIG. 5, flange 30 FIG. 4 and on opposing side, through bottom of receptacle 62, lid 36 FIG. 5 and flange 30 FIG. 4, secured by self locking nuts, not shown.

The bolting process, in addition to securing the units to reservoir 28 and frame 10, causes lid 36 FIG. 5 to compress against the weather stripping on flange 30 FIG. 4, forming a water tight seal, thus preventing water leakage from reservoir 28.

Figure 7:
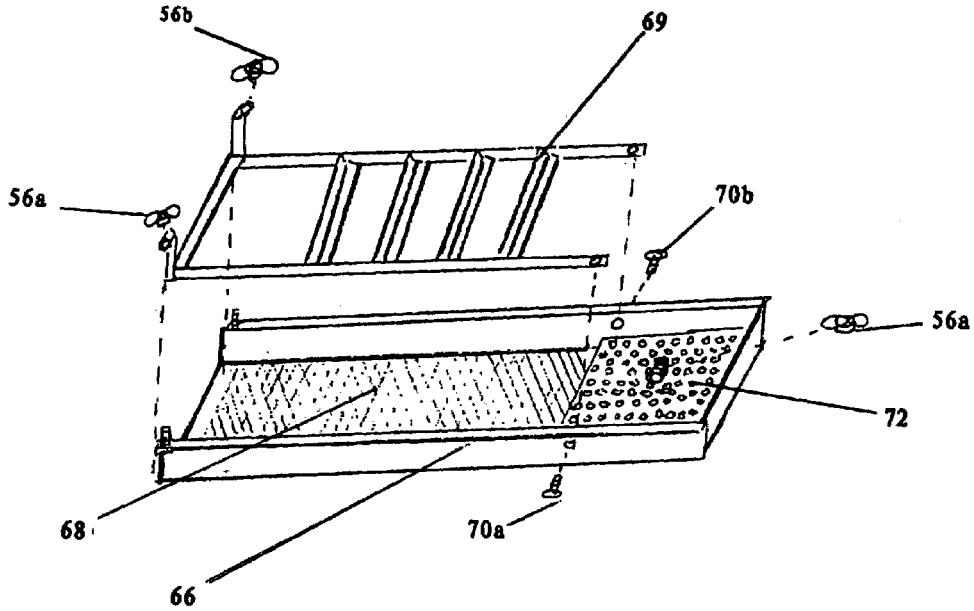
FIG. 7, shows a sluice box assembly

FIG. 2,7, as shown in FIG. 7, a sluice box 66, constructed from 0.080 aluminum, bent to form a bottom, two parallel sides, flanged at the top, an enclosed front and a open back. A suitable combination of ribbed rubber matting, not shown, and miners moss 68 are placed on the bottom of sluice box 66. A removable riffle tray 69 secured to the inside of sluice box 66, with bolts 70. An angled bracket 71, with wing nuts 56*a* secure the back of riffle tray 69 to the end of sluice box 66. A section of punch plate 72 is secured to riffle tray 69 with a wing nut 56*b*, thus forming a trap for the purpose of capturing precious minerals.

Sluice box 66, thus described, is shown as mounted in FIG. 2. The front of sluice box 66 is secured, by bolts, washers and nuts, not shown, to vertical extended front 42. The back of sluice box 66, sloped at a pre determined angle is suitably attached to mounting bracket 44.

Also shown in FIG. 2 is a sluice box extension 74, constructed from 0.080 aluminum, bent to form a bottom, which contains a section of filter screen 76, two sides, flanged at the top, an open front and an open back. Sluice box extension 74 is fastened, by wing nuts 56*a* FIG. 7, to the end of sluice box 66. The end of sluice extension 74, sloping at a suitable angle rests upon the back of filtration box 40, locating filter screen 76 above and in line with sediment pan 54 FIG. 6.

Also shown is a feed hopper 78, constructed from, 0.080 aluminum, bent to form a bottom, two lateral sides and an open front and back. A slit, not shown, is cut into the bottom of feed hopper 78, allowing a predetermined amount of materials to fall through onto sluice box 66 during operation. A grizzly screen 80 FIG. 1, for the purpose of receiving and classifying materials during operation, is attached to the inside of hopper 78, at a suitable distance from its bottom. A vertical support 81 is riveted to feed hopper 78, partially enclosing its back. The front of hopper 78 is aligned with the front of sluice box 66 and is attached by hinge 82 FIG. 1. Vertical support 81 rests upon sluice box 66, allowing hopper 78 to articulate for ease of clean-up. Two nozzles 83 connected by suitable pipe fittings 84, including elbows, T's and unions, are inserted through pre cut holes in support 81 and one side of hopper 78.

FIG. 1, shown is a front prospective view of a completed Wash Plant, in operational mode. A gas operated water pump 86, preferred is a 4 stroke 1", is mounted and secured to extended frame 16 FIG. 3. Pump 86 has a suction 87 and a discharge 88. A hose 89*a* is connected at one end to water port 34, and at its other end to suction 87. Discharge 88 is connected to a manifold, with two ports 90*a* and 90*b*. A hose 89*b* is connected using hose clamp 91, at one end to manifold port 90*b* and at its other end to a control valve 92, using suitable pipe fittings 84 which extend to nozzles 83 FIGS. 1 & 2. A garden hose, not shown, is connected to manifold 90*a*, and is used for cleaning out buckets, and other miscellaneous tasks.

Operations—FIGS. 1 & 2

In the use and operation of the described plant, it is preferred that tools, such as shovels and picks, not shown are placed into implement holder 67, buckets, gold pans and other tools, not shown are placed into receptacle 62 using keyed lock 64 to secure hinged lid 63. Containers, filled with gas, not shown are placed into basket 26.

Reservoir 28 is filled with water, through water fill holes 38*a* & 38*b*. After reservoir 28 has been filled, cover plate 39 is placed over water fill holes 38*a* & 38*b* and secured with wing nuts, or other fasteners.

The unit is attached by hitch 14, to an All Terrain Vehicle, not shown, and transported to a pre selected or known mineral bearing area.

Upon reaching a prospecting area, adjustable jack stand 24, is lowered to the ground, making sure that the unit is level, and locked into place with clevis pin 25. The All Terrain Vehicle is unhitched and moved out of the way.

Cover plate 39 FIG. 6 is removed from water fill holes 38*a* & 38*b* FIGS. 5 & 6. Water pump 86 FIG. 1 is filled with gas and started, allowing it to begin drawing water from reservoir 28, by means of water port 32, water thus drawn, flows through hose 89*a*, up through manifold port 90*b*, through hose 89*b*, through control valve 92, through fittings 84 and is dispensed from nozzles 83, onto grizzly screen 80. Water pump 86 is adjusted until desired water flow is obtained. Materials not shown, are pre classified into buckets, or can be shoveled directly onto grizzly screen 80. Any materials larger than grizzly screen 80 are allowed to fall off the front of feed hopper 78 and are later used to re-fill dig holes. Materials smaller than grizzly screen 80 along with water, pass through onto the bottom of feed hopper 78, through a slit, not shown, onto sluice box 66, precious minerals and heavier materials are trapped by a combination of ribbed matting, not shown, miners moss 68, riffle tray 69 and a piece of punch plate 72. Water and lighter materials, such as gravel and sand, travel down onto sluice extension 74, water and sand are percolated through filter screen 76 and drop into sediment pan 54 FIG. 6, water overflows into filtration box 40 and continues through filtering devices 46, which capture small particles of sand and allow the water to be returned, through water fill holes 38*a* & 38*b*, to reservoir 28.

A bucket, not shown, placed on the ground, beneath sluice box extension 74, is used to catch materials too large to fit through filter screen 76. The bucket also captures any water that is allowed to escape, water is returned to the wash plant, and materials are used to re-fill dig holes.

When "clean out" time is determined control valve 92 is turned to closed position, stopping water flow to grizzly nozzles 83. Any water that is left in sediment pan 54 FIG. 6 is poured into filtration box 40, sand is scraped out, hopper 78 is articulated to provide access to sluice box 66, sluice extension 74 is detached from sluice box 66, punch plate 72 FIG. 7 is removed and riffle tray 69 FIG. 7 is lifted out of the way, miners moss 68 FIG. 7 and ribbed rubber matting, not shown, are placed into a "clean-up" pan, a tub or a bucket, according to preference. A garden hose, not shown, connected to manifold port 90*a*, can be used to spray off any materials which remain in sluice box 66, it is also used to rinse materials which cling to miners moss 68 FIG. 7 and ribbed rubber matting, not shown. Ribbed rubber matting, not shown, and miners moss 68 FIG. 7 are returned to the bottom of sluice box 66, punch plate 72 FIG. 7 is secured with wing nut 57*c* FIG. 7, riffle tray 69 FIG. 7 and sluice extension 74 are secured to sluice box 66 with wing nuts 56*a*. Hopper 78 is lowered onto sluice box 66. The Wash Plant is ready, to "run" more materials. Materials collected during "clean out" can be "panned" now, or saved for later processing.

Conclusions, Ramifications and Scope,

It will be observed that a wash plant thus described will serve to meet the anticipated needs of the recreational prospector, for prospecting with water, in mineral bearing regions that are arid in nature, have little or no water or limited water usage, due to environmental concerns. The main advantages are;

It is designed to be used in conjunction with a n All Terrain Vehicle, but is light enough, to be easily "loaded" into the back of a pick-up truck or on a trailer and be maneuvered by hand.

It has a reservoir for holding and transporting its own water, making it capable of, but not limited to, being used in regions where there is no water.

It is environmentally "friendly", using a filtration and recirculating system, allowing the same water to be used continuously, for several applications.

It has a receptacle, implement holder and cargo basket, capable of carrying all tools and prospecting needed in the field.

It has, in a feed hopper and sluice box assembly, along with a water pump, a method and mean for separating precious minerals from sand and gravel.

It should be noted that although the drawings and descriptions contain many specifications, various modifications may be made without departing from the scope of the invention, as will be recognized by those practitioners skilled in the art.

Therefore the invention is not limited by that which is shown in the drawings and described in the specifications. Thus the scope of the invention should be determined by the claims.

What is claimed is:

1. A transportable, self-contained wash plant, comprising;

(a) a frame, said frame having a tongue and hitch, said frame being attached to a set of axles with tires, an adjustable jack stand being welded to said frame, said frame having a front extension;

(b) a water pump, having a suction hose and a discharge hose, said discharge hose being attached to a manifold, said manifold being connected to a control valve, said water pump being mounted on said extension of said frame;

(c) a water reservoir, said reservoir being of a predetermined size, said reservoir having a bottom, four sides and a lid, said sides being flanged, said reservoir having a water drain on the backside of said reservoir, a water port on the front side of said reservoir and a water reservoir water fill hole on the top of said lid of said reservoir, said reservoir water fill hole having a plurality of bolts, surrounding said reservoir water fill hole, said reservoir being mounted on and attached to said frame, said water port being connected to said suction hose on said pump;

(d) a filtration box, being of a predetermined size, having two parallel sides, a back side, an extended front side and a bottom, said filtration box having a rear vertical mounting bracket, said bottom of said filtration box having a filtration box water fill hole, said filtration box water fill hole being equal in dimensions to said water reservoir water fill hole, said filtration box water fill hole having a guard, said guard having a rim, said rim having a plurality of bolt holes, said filtration box being mounted on said lid of said reservoir, said bolts on said rim passing through said bolt holes, surrounding said water reservoir water fill hole, said reservoir water fill hole and said filtration box water fill hole becoming aligned;

(e) a cover plate, said cover plate being place over said water reservoir water fill hole and said filtration box water fill hole being attached with a plurality of fastening devices;

(f) a sluice box, having a bottom, an enclosed head, an open back and two parallel sides, said sides being flanged at the top, said bottom containing a combination of ribbed rubber matting, miners moss, a piece of punch plate and a riffle tray, said sluice box, being placed at a predetermined angel and mounted on said extended front and said vertical mounting bracket of said filtration box;

(g) a feed hopper, said feed hopper having two laterally sloping sides, a bottom, an open front and a back said back being partially enclosed by a support bracket, a nozzle being attached to one side of said feed hopper, said nozzles being connected by a plurality of pipe fittings, being connected to a control valve, said control valve being connected to said discharge of said water pump, said feed hopper having a grizzly screen, said grizzly screen being attached to said sides of said feed hopper at a predetermined distance above said bottom, said bottom having a slit of a predetermined size, said front of said feed hopper being attached by a hinge to said front of said sluice box, said support brackets of said feed hopper being rested upon said sides of said sluice box.

2. The transportable, self-contained wash plant of claim 1, the filtration box further comprising, a removable sediment pan, said sediment pan being of a predetermined size, having a bottom and four sides, said filtration box further including a plurality of slots and a predetermined amount of filtering devices, said sediment pan being placed inside of and to one end of said filtration box, said slots being located at a predetermined distance, between said sediment pan and said water reservoir fill hole and said filtration box water fill hole said filtering devices being placed at a predetermined angle into said slots.

3. The transportable, self-contained wash plant of claim 2, the sluice box further comprising;

a detachable extension, said extension having two sides and a bottom, said sides being flanged at the top, said bottom having a filter screen, of a predetermined size, said extension being attached to said sluice box by a plurality of fastening devices, said extension sloping at a predetermined angle, being rested upon said filtration box, allowing said filter screen to be located directly above said sediment pan.

* * * * *